United States Patent [19]

Meyer

[11] Patent Number: 4,696,472

[45] Date of Patent: Sep. 29, 1987

[54] THROWING TOY AND METHOD OF MANUFACTURE

[76] Inventor: David L. Meyer, 3285 Old Salem Rd., Albany, Oreg. 97321

[21] Appl. No.: 929,729

[22] Filed: Nov. 12, 1986

[51] Int. Cl.[4] ..... A63B 43/02

[52] U.S. Cl. ..... 273/58 A; 273/58 C

[58] Field of Search ..... 273/416, 420, 423, 428, 273/58 R, 58 A, 58 C, 199 A, 319, 330

[56] References Cited

U.S. PATENT DOCUMENTS

| | | | |
|---|---|---|---|
| D. 20,187 | 10/1890 | Herrick | 273/58 R |
| 1,670,810 | 5/1928 | Humphreys | 273/58 A |
| 1,898,817 | 2/1933 | Dole | 273/58 A |
| 2,944,817 | 7/1960 | Stiller | 273/58 C |
| 3,147,979 | 9/1964 | Wolfe | 273/58 C |
| 3,759,518 | 9/1973 | Mroz | 273/58 A |
| 3,934,873 | 1/1976 | Griffin | 273/58 C |
| 4,088,319 | 5/1978 | Clark | 273/58 R |
| 4,294,447 | 10/1981 | Clark | 273/58 R |
| 4,321,888 | 3/1982 | Topliffe | 273/58 K |
| 4,657,253 | 4/1987 | Lerner et al. | 273/58 A |

*Primary Examiner*—George J. Marlo
*Attorney, Agent, or Firm*—Norman B. Rainer

[57] ABSTRACT

A throwing toy is comprised of a spherical ball filled with foam rubber, and a long tether tail, one end of which is anchored within the center of the ball. The tail is preferably a light weight strong ribbon having visibly distinctive indicia. The tether is used to swing the toy prior to its release for airborne travel, and to catch the toy upon its descent. The ball includes a diametrically aligned slot and cylindrical channel. One end of the ribbon is anchored at the center of the ball, where the slot meets the channel. The ribbon is assembled to the ball by inserting a tool including a hook into the slot, then through the cylindrical channel, and then hooking a loop at the end of the ribbon, and then pulling the loop to the center of the ball. The loop containing end of the ribbon may be withdrawn from the ball through the slot, and a metal rod may be placed in the loop, which is then pulled into its anchoring position at the center of the ball.

5 Claims, 5 Drawing Figures

THROWING TOY AND METHOD OF MANUFACTURE

BACKGROUND OF THE INVENTION

This invention relates to an amusement device and, more particularly, to a projectile toy and a method for its manufacture.

Numerous throwing toys, well known in the art, are comprised of a resilient ball having a tether secured thereto. Typical embodiments of such toys are disclosed in U.S. Pat. Nos. Des. 20,187; 1,670,810; 4,088,319; and 4,294,447.

In the use of such toys, the extremity of the tether remote from the ball is grasped, and the ball is whirled about and the tether is released when the ball is traveling in the desired direction. In flight, the ball precedes the tether which trails as an elongated, almost straight tail. The toy may be thrown in the air and caught by the ball or tail as it comes down, or the toy may be thrown to another player who will catch it by the ball or tail.

The considerable centrifugal force which may be generated as the ball is whirled in a circular path prior to its release can cause the ball to separate from the tether. In prior toys of this nature, attachment of the tether to the ball has been inadequate or has been achieved at considerable manufacturing expense, or has compromised the performance or appearance of the toy. the tether means utilized in prior toys have also lacked sufficient tensile strength to resist breaking during use, and have generally not been amenable to the carrying of printed indicia such as names and messages visibly discernible during flight.

It is accordingly an object of the present invention to provide a toy comprised of a resilient ball having a securely affixed tether.

It is another object of this invention to provide a toy as in the foregoing object wherein said tether will function as a trailing tail when the toy is thrown.

It is a further object of the present invention to provide a toy of the aforesaid nature wherein said tether has sufficient tensile strength to resist breakage during use.

It is yet another object of this invention to provide a toy of the aforesaid nature wherein said tether can carry visibly discernible indicia.

It is a still further object of the present invention to provide a toy of the aforesaid nature of rugged construction and a simple method for its manufacture, resulting in a low cost toy product.

These objects and other objects and advantages of the invention will be apparent from the following description.

SUMMARY OF THE INVENTION

The above and other beneficial objects and advantages are accomplished in accordance with the present invention by a throwing toy comprising:

(a) a spherically surfaced ball whose interior is comprised of resilient foam material, and having: (1) a circular cylindrical channel extending from an interior extremity at the center of the ball to the surface of the ball and (2) a slot defined by paired facing flat surfaces joined at straight parallel side extremities, said slot extending from the surface of the ball to the center thereof in communication with said channel and centered upon a line which when extended is coaxial with the axis of said channel and constitutes a diameter of the ball, the width of said slot, measured between its parallel side extremities being greater than the diameter of said channel, and the depth of said slot, measured between said paired flat surfaces being smaller than the diameter of said channel, (b) a tether comprising a flat ribbon elongated between anchored and free extremities fabricated of lightweight fibrous material of high tensile strength having a width of $\frac{3}{4}$ to 2 inches measured between opposed boundary edges and a length of 3 to 5 feet measured between said anchored and free extremities, said anchored extremity having a loop extending transversely to the long axis of the ribbon, and (c) a straight rigid anchoring member insertively engaging said loop and extending beyond each edge of the ribbon in transverse abutment with the circular channel at its interior extremity, whereby (d) a portion of the ribbon adjacent its anchored extremity passes through said channel in gathered form.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
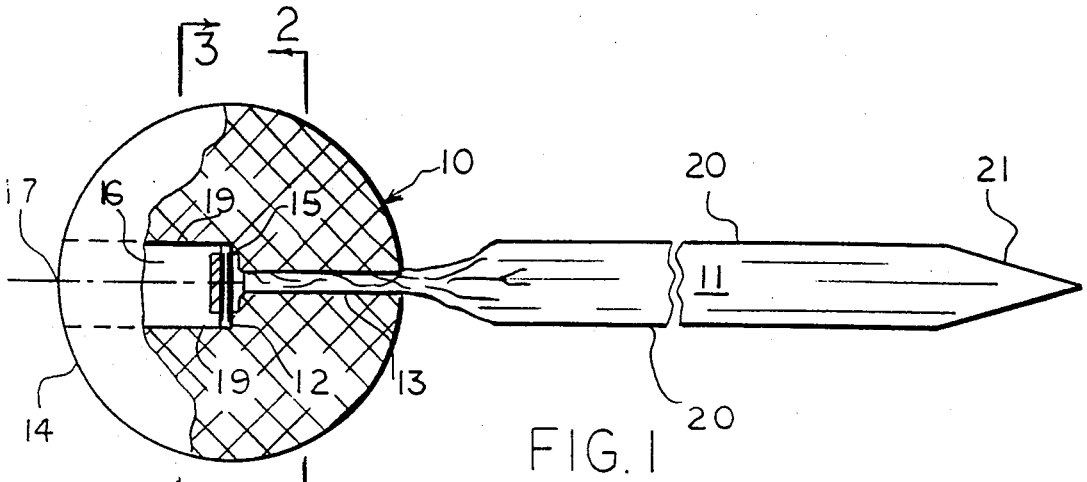
FIG. 1 is a plan view of an embodiment of the toy with portions cut away to reveal interior details.
Figure 2:
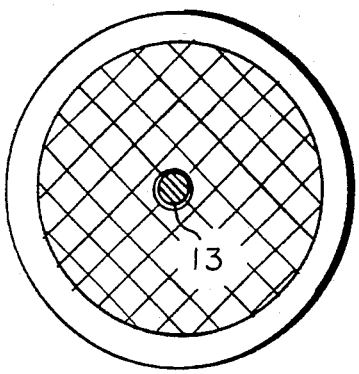
FIG. 2 is a sectional view taken along the line 2—2 of FIG. 1.
Figure 3:
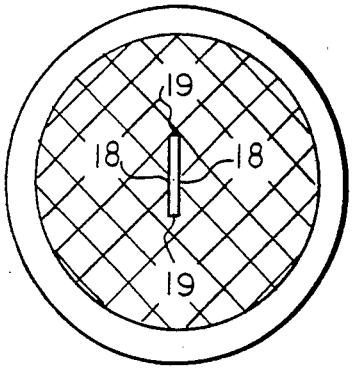
FIG. 3 is a sectional view taken along the line 3—3 of FIG. 1.

Referring to the drawing, a throwing toy of the present invention is shown comprised of a spherical ball 10 in association with an elongated flat tether 11 and an anchoring member 12.

The interior of the ball is comprised of a resilient foam material produced from a resilient substance such as polyurethane, rubber, polyethylene, neoprene, butadiene-styrene copolymers, and equivalent substances. A channel 13 of circular cylindrical contour extends from the spherical surface 14 of the ball to an interior extremity 15 located at the center of the ball. The diameter of the channel may range between about $\frac{1}{8}''$ and $\frac{3}{8}''$, and the diameter of the ball may range between about 2" and 7".

A straight slot 16 defined by paired flat surfaces 18 and straight side extremities 19 extends from the surface of the ball to its center, and communicates with the interior extremity of the channel. The slot is centered upon a line 17 which when extended is coaxial with the axis of the channel, and constitutes a diameter of the ball. The width of the slot, measured between parallel side extremities 19, is greater than the diameter of the channel, and said extremities 19 are equally spaced from opposite sides of the channel. The depth of slot 16, measured between paired flat surfaces 18, is smaller than the diameter of the channel, and said surfaces 18 are equally spaced about the center axis of the channel. Said paired flat surfaces 18 may in fact be in contacting abutment.

The slot and channel within the ball may be formed during the molding of the ball or by subsequent cutting operations.

The tether is an elongated flat ribbon fabricated of a lightweight fibrous material such as a high strength fabric woven of synthetic filaments such as nylon, polyester or the like. The ribbon has a width of between about ¾ and 2 inches, measured between opposed boundary edges 20. One extremity of the ribbon is an anchored extremity 22 located within the ball, as will be described. The opposite or free distal extremity 21 of the ribbon may be tapered to a point, or may have other configurations. The length of the ribbon, measured between said anchored and free extremities, may range between about 3 and 5 feet. The anchored extremity has a loop 23 extending transversely to the long axis of the ribbon, said loop having been formed by a doubling of the ribbon and sewing or equivalent manner of joinder of the doubled fabric.

A straight anchoring member such as rod 12 passes through loop 23 and lies in tranverse abutment with the interior extremity of channel 13.

Figure 4:
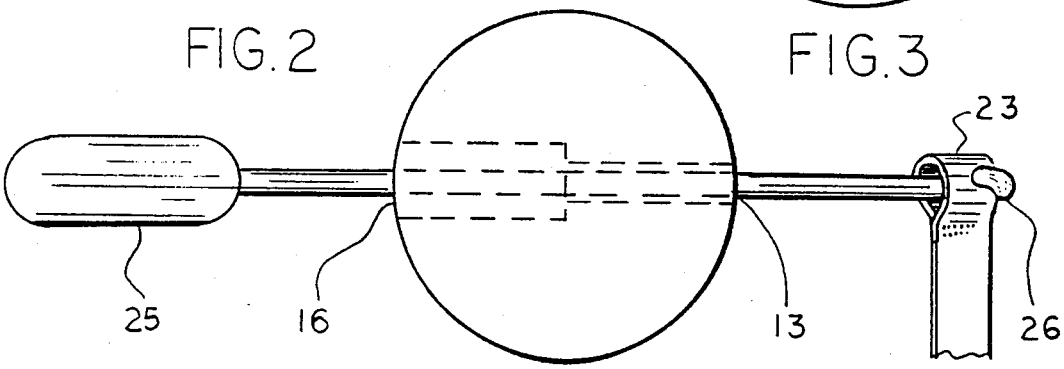
FIGS. 4 and 5 illustrate the method of assembly of the components of the toy.
Figure 5:
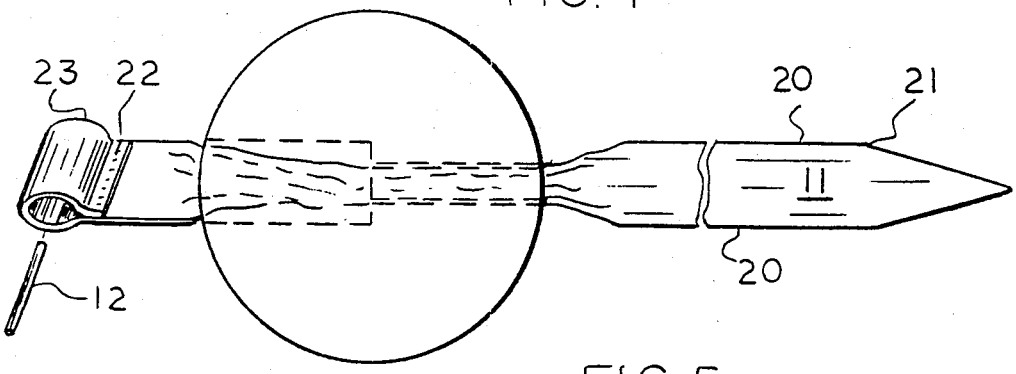

The toy is assembled using an elongated tool 25 having a hook extremity 26. As shown in FIGS. 4 and 5, the hook extremity is entered through slot 16 and emerges through channel 13. The hook is then caused to engage the loop 23 of the ribbon, and the tool is withdrawn through the ball, carrying the ribbon with it. Rod 12 is then inserted through loop 23. The ribbon emergent through channel 13 is then pulled upon to cause rod 12 to enter slot 16 and move into seated abutment with the interior extremity of the channel at the center of the ball.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention what is claimed is:

1. A throwing toy comprising:

(a) a spherically surfaced ball whose interior is comprised of resilient foam material, and having: (1) a circular cylindrical channel extending from an interior extremity at the center of the ball to the surface of the ball and (2) a slot defined by paired facing flat surfaces joined at straight parallel side extremities, said slot extending from the surface of the ball to the center thereof in communication with said channel and centered upon a line which when extended is coaxial with the axis of said channel and constitutes a diameter of the ball, the width of said slot, measured between its parallel side extremities being greater than the diameter of said channel, and the depth of said slot, measured between said paired flat surfaces being smaller than the diameter of said channel, (b) a tether comprising a flat ribbon elongated between anchored and free extremities fabricated of lightweight fibrous material of high tensile strength having a width of ¾ to 2 inches measured between opposed boundary edges and a length of 3 to 5 feet measured between said anchored and free extremities, said anchored extremity having a loop extending transversely to the long axis of the ribbon, and (c) a straight rigid anchoring member insertively engaging said loop and extending beyond each edge of the ribbon in tranverse abutment with the circular channel at its interior extremity, whereby (d) a portion of the ribbon adjacent its anchored extremity passes through said channel in gathered form.

2. A method for assembling the throwing toy of claim 1 comprising:

(a) utilizing an elongated tool having a hook extremity, (b) causing said hook extremity to enter said slot and emerge through said channel, (c) engaging said loop by said hook extremity, (d) withdrawing said hook extremity from said ball while holding said loop and carrying said ribbon, but leaving a portion of said ribbon emergent from the channel, (e) inserting said anchoring member through said loop, and (f) pulling upon the portion of the ribbon emergent from the channel to cause said anchoring member to enter said slot and move into seated abutment with the interior extremity of the channel at the center of the ball.

3. The throwing toy of claim 1 wherein said anchoring member is a metal rod.

4. The throwing toy of claim 1 wherein the opposed boundary edges are straight and parallel.

5. The throwing toy of claim 1 wherein said ribbon contains visibly distinctive indicia.

* * * * *